United States Patent [19]

McGrew

[11] 4,320,550

[45] Mar. 23, 1982

[54] PAINT ROLLER CLEANING APPARATUS

[76] Inventor: James McGrew, 7430-1/2 Girard Ave., La Jolla, Calif. 92037

[21] Appl. No.: 151,359

[22] Filed: May 19, 1980

[51] Int. Cl.[3] ..... B05C 21/00; B08B 1/00

[52] U.S. Cl. ..... 15/3; 15/104.92

[58] Field of Search ..... 15/1, 3, 104.92, 38; 134/138, 139, 149

[56] References Cited

U.S. PATENT DOCUMENTS

| | | | |
|---|---|---|---|
| 2,773,274 | 12/1956 | Beech | 15/3 |
| 2,895,154 | 7/1959 | Belcher | 134/149 |
| 3,200,428 | 8/1965 | Fuller | 15/38 X |
| 3,431,574 | 3/1969 | Mathieu | 15/104.92 |
| 3,818,529 | 6/1974 | Leggett | 15/1 |

*Primary Examiner*—Edward L. Roberts
*Attorney, Agent, or Firm*—Ralph S. Branscomb

[57] ABSTRACT

A simplified paint roller cleaning apparatus is provided wherein an existing paint roller spinner is utilized to insert a paint roller into a container of paint solvent where it is temporarily supported at the bottom against an idler roller. The idler roller spindle extends through a slot in the top of the container and a handle on the spindle permits the idler roller and spinner to be compressed together as the spinner is actuated, causing the rollers to rotate together to clean the paint roller. Then the solvent is poured out, the idler roller is tipped aside and the paint roller is dry-spun in the container to expel excess moisture.

10 Claims, 4 Drawing Figures

PAINT ROLLER CLEANING APPARATUS

BACKGROUND OF THE INVENTION

Painting with rollers as opposed to brushes is virtually universal in situations where broad surfaces need to be coated. Some rollers are made very cheaply with the intent that they be discarded after use, but the better rollers, such as those made with lambs wool, are sufficiently expensive that discarding them is a needless waste.

Of course if the roller is not discarded the problem of cleaning it becomes paramount. The technique used by most amateur painters is to run tap water over the roller continuously until paint ceases to leach out of the roller nap. However, anyone who has done this will testify that the nap of the roller seems to contain an endless supply of paint, and the painter will stand for many minutes, wringing out the nap under the constantly flowing water, until a reasonable clear rinse solution indicates most of the paint has been purged.

More efficient devices have been developed utilizing solutions in containers with rotary cranks which operate the paint roller in the solution against some kind of squeegee bar. However, those that have been patented typically are complicated and would be prohibitively expensive to manufacture and awkward to use, not to mention probably messy. Apparently none of these devices have ever been marketed.

A device which has been successfully marketed and is quite handy is the paint roller spinner. This spinner, in some of its implementations also capable of spinning paint brushes, engages the paint roller from the inside and rotates it rapidly along its longitudinal axis, either under a water faucet or in the open air and is helpful in cleaning the roller. The pair spinner is an integral part of the instant invention.

SUMMARY OF THE INVENTION

The roller cleaner assembly disclosed herein utilizes the above described paint spinner and provides a solvent container with an idler roller inside which is brought to bear against the paint roller as it is spun on the spinner. The solvent container is a rectangular can which has a removable base in the bottom which mounts the bottom tip of the idler roller spindle. Adjacent this mount is a hub over which the paint roller to be cleaned is inserted so that the bottoms of both rollers are in mutual contact.

The top of the container has a cover over approximately half of the otherwise open top, and a slot in this cover seats the top of the spindle above the idler roller, limiting the idler roller to one dimensional, pivotal motion. A handle on the idler roller spindle is compressed together against the top of the spinner, or non-spinning handle portion of the spinner, and as the two rollers are compressed together the spinner is operated by pumping the actuator, causing the paint roller to spin, thereby driving, and simultaneously being rinsed by the idler roller, which has an external helical bead or other irregular surface configuration to aid in compressing the paint out of the paint roller.

DETAILED DESCRIPTION OF THE PREFERRED EMBODIMENT

Figure 1:
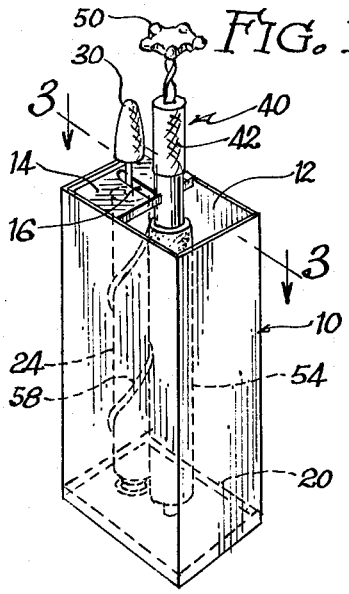
FIG. 1 is a perspective view of the apparatus showing the interior in phantom.
Figure 3:
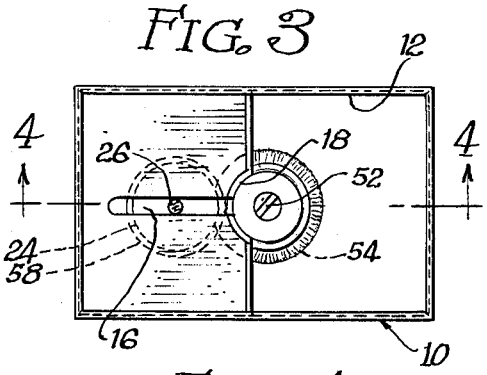
FIG. 3 is a section taken along line 3—3 of FIG. 1.

The apparatus includes a container 10 which in the illustrated embodiment is box-shaped, having a horizontal cross-section about the size of a gallon gasoline can, and a somewhat greater height. The container is partially open at the top at 12, there being a partial cover 14 spanning about half the top and having re-entrant slot 16 and a cutaway circular segment 18.

Inside the container is a base 20 which could be made of wood, aluminum or other suitable material and in its preferred form is a solid block for rigidity, as the base must withstand a certain amount of stress in use. The base is also preferably removable, being dimensioned to slip out of the opening 12 in the top of the container for cleaning and replacement of damaged parts.

Mounted on top of the base directly below the slot or groove 16 is a small socket 22. This socket is shown as an inverted cup with a central opening which is screwed to the base, but any suitable means of defining an opening is well within the intended scope of the disclosure and claims.

An idler roller 24 is secured inside the container on a spindle 26 which may be crimped at 28 to prevent removal of the roller from the spindle. Although conceivably this roller could be replaced by a stationary squeegee bar a roller is more effective and easier to operate. The bottom tip of the spindle is loosely engaged in the socket 22, to permit pivotal or angular motion of the spindle about the socket and its top passes out through the slot 16 and is capped with a handle 30. The handle is rigid with the spindle so that the roller rotates around the stationary spindle. The idler roller with its spindle can easily be removed by sliding it free of the slot 16 and lifting it through the opening 12 and while engaged beneath the top portion 14 is of length dimension sufficient to prevent floating up with its spindle to disengage the socket 22.

Alongside the socket 22, and very carefully spaced therefrom, is a rotatable hub 32. In the illustrated embodiment this hub is journaled on an upright bolt 34, secured with a wing nut 36 and maintained above the surface of the base by a spacer sleeve 38 and a washer that rests on the spacer sleeve for easy rotation of hub. The hub is thus replaceable by removl of the wing nut.

The above stated structure represents the totality of the apparatus which is fabricated by the inventor. An off-the-shelf roller spinner shown at 40, or the equivalent, is necessary for the operation of the instant roller cleaning apparatus. This roller cleaner has a central body portion 42 with a stationary upper handle portion 44, neither of which rotates, and bowed roller grippers 48 which frictionally and very firmly engage the roller from the interior. The top portion of the roller spinner comprises a handle 50 which operates a twisted pumping shaft 52 which, when reciprocated, causes the bands 48 to rapidly spin in one direction.

After numerous uses the roller grippers 48 may lose their resilience and diminish the frictional engagement with the roller. The apparatus demands a degree of downward pressure of the roller spinner when in operation, and the hand compression of spinner and idler aids this frictional engagement considerably. However, if the roller grippers lost too much of its gripping force and become loose in the roller, a simple remedy is to roll several winds of tape around the grippers to increase its frictional engagement.

Figure 4:
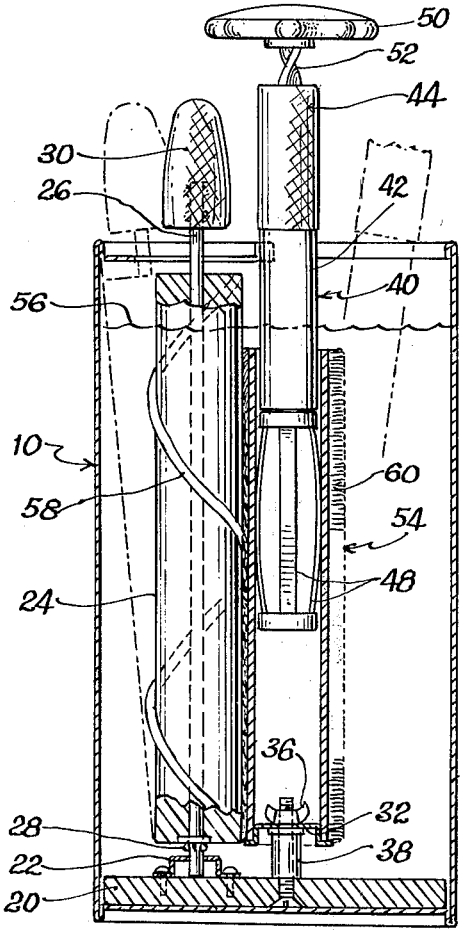
FIG. 4 is a section taken along line 4—4 of FIG. 3, showing the device in use.

After a roller, shown at 54, is engaged on the gripper portion of the spinner, it is inserted into the container, with the open bottom being slipped over the rotatable hub 32. The hub acts as a detaining means in the container adjacent the cleaner bar for engaging the bottom of a roller and permitting at least limited angular movement of the roller thereon against the cleaning bar or idler roller. In operation of the device, at some point the container is filled with a solvent liquid 56, which in the case of Latex paint is just water. As shown in FIG. 4, when ready for use the stationary handle 44 of the spinner fits into the cutaway 18 and is compressed together with the handle 30 of the idler roller are compressed together by one hand, with the other hand being used to reciprocate the handle 50. As the handle is reciprocated, the paint roller 54 acts as a driver roller to rotate the idler roller 24, which in the illustrated embodiment has a helical bead 58 which when rotated has a virtual movement in the downward direction, acting something like a squeegee to aid in the cleaning of the bristles or nap 60 of the paint roller. The exterior surface of the idler roller could be provided with a rough, bumpy surface in addition to or in place of the helical groove, or it could be smooth and still work, although perhaps with reduced efficiency.

Figure 2:
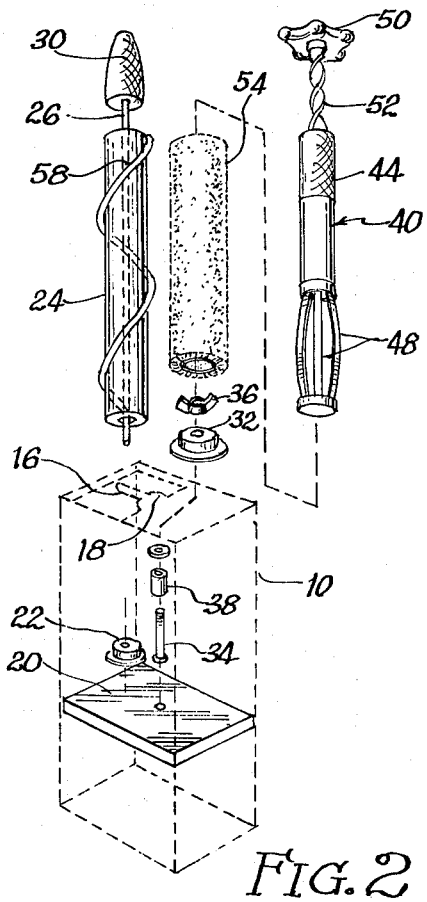
FIG. 2 is an exploded perspective of the apparatus.

Because of the unique ability of the operator to control the pressure between the paint roller and the idler roller by hand pressure, paint rollers of differing nap thicknesses can all be accommodated without requiring any special adjustable structure. If the nap is thicker, of course the spacing between the two rollers would be made somewhat greater by the use of a more open handgrip, with about the same pressure being appled. An additional advantage is that all the parts of the apparatus are removable for cleaning and replacement, and come apart as shown in the exploded view in FIG. 2. The complete operation of the unit ordinarily would somewhat parallel the following lines. First, the roller is removed from the roller handle and inserted on the spinner 46 and engaged on the hub 32, and is then compressed against the idler roller. Then, the container is filled with a solvent, usually water. The spinner is pumped several times in the fluid to clear the nap of most paint. The hand compressing the two handles 30 and 44 together is left in place, and the other hand is used to dump the solvent from the bucket. After the water has been dumped, the idler roller 24 is tilted out of the way in its slot 16 and the paint roller is spun in the air within the container to expel residual paint and solvent. The process can then be repeated with a second charge of clean solvent if desired, in which case a few seconds of pumping with the second solvent charge will thoroughly clean the roller.

Although sounding somewhat more complicated than the usual procedure of holding the roller beneath a faucet for a few minutes, in actual practice an enormous amount of time is saved, which is important especially to professional painters, into which category the inventor falls, who may be using several rollers at once on a job and for whom time is money. It also mitigates against the impulse to discard used rollers rather than take the time to rinse them, which was formerly such a time consuming procedure. Although as has been indicated in the background, this problem has been fully appreciated in the past, never has such an inexpensive to produce and simple to operate apparatus been conceived or produced for use by professional and amateur painter alike.

What is claimed is:

1. An apparatus for cleaning a paint roller comprising:

(a) a roller spinner;

(b) a solvent container;

(c) a cleaner bar mounted substantially upright in said container;

(d) detaining means in said container adjacent said cleaner bar for engaging the bottom of a roller inserted in said container and permitting at least limited angular movement of a roller thereon against said cleaner bar whereby a roller engaged on a roller spinner and engaged on said detainer means can be pivotally pressed against said bar and spun on said spinner in solvent in said container and against said cleaner bar, and subsequently removed on said spinner to be spun-dry in the container after the solvent is dumped.

2. Structure according to claim 1 wherein said detaining means is a rotatable hub over which an open end of a paint roller can be slipped.

3. Structure according to claim 1 and including a removable base member resting on the bottom of said container, said removable base member mounting said detaining means and the bottom end of said cleaning bar.

4. An apparatus for cleaning a paint roller comprising:

(a) a roller spinner;

(b) a solvent container;

(c) a cleaner bar mounted substantially upright in said container;

(d) detaining means in said container adjacent said cleaner bar for engaging the bottom of a roller inserted in said container whereby a roller engaged on a roller spinner and engaged on said detainer means can be spun on said spinner in solvent in said container and against said cleaner bar, and subsequently removed on said spinner to be spun-dry in the container after solvent is dumped:

(e) a removable base member resting on the bottom of said container, said removable base member mounting said detaining means and the bottom end of said cleaning bar; and (f) said cleaner comprises a cleaner roller rotatably mounted on an axial spindle, and including a spindle detaining means releasable engaging the bottom of said spindle, and said base member releasably mounts said detaining means whereby said base member and both rollers are removable from said container and separable for repairs nd cleaning.

5. Structure according to claim 4 wherein said cleaner roller has an exterior helical bead to squeegee said paint roller from one to the other.

6. An apparatus for cleaning a paint roller comprising:

(a) a roller spinner, (b) a solvent container;

(c) a cleaner bar mounted substantially upright in said container;

(d) detaining means in said container adjacent said cleaner bar for engaging the bottom of a roller inserted in said container, whereby a roller engaged on a roller spinner and engaged on said detainer means can be spun on said spinner in solvent in said container and against said cleaner bar, and subsequently removed on said spinner to be spun-dry in the container after solvent is dumped; and (e) a base member in the bottom of said container, and said cleaner bar comprises a cleaner roller rotably mounted on an axial spindle pivotally detained on said base.

7. Structure according to claim 6 wherein said spindle has a handle on the top extending clear of said container, and said spinner has a non-spinning handle adjacent said spindle handle, whereby upon manually compressing said handles together and operating said spinner, said rollers rotate cooperatively to rinse paint from said paint roller.

8. Structure according to claim 7 wherein said container has a top cover extending partially thereover to leave room for insertion and removal of said paint roller, and said cover is slotted to receive the spindle of said cleaner roller, thereby capturing said cleaner roller beneath said roller and permitting the mutual compression of said rollers.

9. An apparatus for cleaning a paint roller comprising:

(a) a solvent container (b) detaining means on the bottom of said container for releasable and rotatably detaining a roller upright in said container;

(c) a cleaning bar pivotally attached at the bottom of said container, adjacent said detaining means and being free of said roller permitting said roller to rotate freely;

(d) means for rotating said roller in said container, whereby said roller can be rolled against said cleaner bar by holding said cleaner bar against said roller to clean same in solvent, and then by removing said solvent said roller can be spun free within the container to dry same, free of said cleaner bar.

10. An apparatus for cleaning a paint roller comprising:

(a) a solvent container;

(b) a cleaning bar mounted upright within said container;

(c) a roller spinner releasably engageable with a paint roller, said roller spinner having the independent capability of spinning said roller free of said container;

(d) detaining means at the bottom of said container adjacent said cleaning bar and capable of rotatably engaging the free end of a roller engaged on said roller spinner and permitting a roller engaged on said roller spinner to be swung against said cleaner bar, whereby said roller can be inserted into said container and rotated in cleaning fluid against said cleaner bar, and then removed on the spinner free of the container to be spun on said spinner to spin off absorbed solvent.

* * * * *